US006813976B2

(12) United States Patent
Malvini et al.

(10) Patent No.: US 6,813,976 B2
(45) Date of Patent: Nov. 9, 2004

(54) TETHERED HAND TOOL

(76) Inventors: Phillip Joseph Malvini, 981 Glenridge Dr., San Jose, CA (US) 95136; Daniel Cornell, 330 Arboleda Dr., Los Altos, CA (US) 94024

( * ) Notice: Subject to any disclaimer, the term of this patent is extended or adjusted under 35 U.S.C. 154(b) by 0 days.

(21) Appl. No.: 10/262,323

(22) Filed: Oct. 1, 2002

(65) Prior Publication Data

US 2003/0061917 A1 Apr. 3, 2003

Related U.S. Application Data

(60) Provisional application No. 60/326,612, filed on Oct. 1, 2001.

(51) Int. Cl.[7] ..... B25B 7/00

(52) U.S. Cl. ..... 81/300; 81/416; 81/180.1; 7/127

(58) Field of Search ..... 81/300, 415, 416, 81/180.1; 7/127

(56) References Cited

U.S. PATENT DOCUMENTS

| | | | | |
|---|---|---|---|---|
| 346,583 A | | 8/1886 | Corbett | |
| 752,339 A | | 2/1904 | Gutstein | |
| 1,436,948 A | | 11/1922 | Dedio | |
| 2,437,786 A | * | 3/1948 | Oberdorf et al. | 242/382.4 |
| 2,469,978 A | | 5/1949 | Mrozinski | |
| 3,635,140 A | | 1/1972 | Wolf | |
| 3,875,600 A | | 4/1975 | Reveaux | |
| 4,206,983 A | | 6/1980 | Nettman et al. | |
| 4,328,917 A | | 5/1982 | Reeberg | |
| 4,687,309 A | | 8/1987 | Breslau | |
| 4,714,184 A | | 12/1987 | Young et al. | |
| 4,752,792 A | | 6/1988 | Keith | |
| 4,880,491 A | | 11/1989 | Jacobs et al. | |
| 4,895,336 A | | 1/1990 | Lieberman | |
| 4,901,938 A | | 2/1990 | Cantley et al. | |
| 4,991,758 A | | 2/1991 | Eaneff | |
| 5,034,759 A | | 7/1991 | Watson | |
| 5,078,438 A | | 1/1992 | Bieganski | |
| 5,090,277 A | | 2/1992 | Spiller | |
| 5,124,685 A | | 6/1992 | Rankin | |
| 5,152,095 A | | 10/1992 | Combs, III | |
| 5,450,670 A | | 9/1995 | Sakai | |
| 5,551,545 A | | 9/1996 | Gelfman | |
| 5,555,589 A | | 9/1996 | Moultrie | |
| 5,697,572 A | | 12/1997 | Salentine et al. | |
| 5,850,649 A | * | 12/1998 | Simpson | 7/106 |
| 5,938,137 A | | 8/1999 | Poulson | |
| 5,967,444 A | | 10/1999 | Poffo | |
| 6,419,175 B1 | | 7/2002 | Rankin, VI | |

* cited by examiner

*Primary Examiner*—Debra S. Meislin
(74) *Attorney, Agent, or Firm*—GSS Law Group; Gregory Scott Smith

(57) ABSTRACT

This invention is a hand tool tethering system for use with hand tools that includes a retractor adapted to be included in a housing of the hand tool, a tether attached to the hand tool's retractor mechanism at one end, and to and a coupling device at the opposite end for attachment to an operator or to a selected support structure. The retractor mechanism allows the tether to be movable between a stored position and a functional position.

18 Claims, 5 Drawing Sheets

TETHERED HAND TOOL

CROSS-REFERENCE TO OTHER APPLICATIONS

This application claims the benefit of US Provisional Patent Application No. 60/326,612, filed Oct. 1, 2001.

FIELD OF THE INVENTION

The present invention pertains to tethering of tools and more particularly to the placement of a retraction mechanism allowing for the useful tethering of a tool to the operator or to some other selected anchor.

BACKGROUND OF THE INVENTION

Operators of hand tools frequently spend time in search of the location and proper orientation of these hand tools. In the performance of their various tasks, operators of hand tools may be mobile, traveling between several locations, and moving between various surfaces surrounding the operator. The operator may also be distracted by having several different tools on a work surface.

Many existing hand tool organization and retention devices have been created in an effort to decrease this search time and thereby maximizing the productivity of the operator. One such pre-existing device is a tool belt allowing the operator of the hand tools to have these tools readily available as his work locations change. Tools belts keep tools organized and each tool is kept in a known orientation. An enhancement to this useful invention is a tethering mechanism preventing the tool from getting too far from the operator and automatically returning to a known position on the operator. The tether precludes the tool from falling too far away from the operator as could happen at elevated heights, and may reduce the time required for the operator to return the tool to a known position.

A common feature of many preexisting tethering mechanisms is that they have the retracting mechanism for the tether located at the end attached to the operator. The space required for the retracting mechanism limits the number of such tethered tools available to an operator. In addition, special care must be taken to prevent the jamming of the tether during the retraction process because the orientation of the tool with respect to the retracting mechanism may be changing as the tool moves closer to the retractor.

A few preexisting tools have a retractor mechanism coupled to the tool rather than the user or other support structure. However, the location of the retractor mechanism is often inconvenient, and a poorly positioned retractor mechanisms can interfere with easy use of the tool.

What is needed is a tethered hand tool incorporating a retractable tether mechanism that is positioned in a location that does not interfere with the easy use of the tool. It may also be desirable for the tool to include apparatus for controlling the retraction of the tool located on the tool for easy one handed access by the user.

SUMMARY OF THE INVENTION

The invention includes a tethering apparatus for use with hand tools in which the apparatus is adapted to be attached to, or incorporated into, the hand tool and having the opposite end of a tether adapted for attachment to an operator or support structure. Like pre-existing tethers, the invention can prevent a hand tool from getting too far from the operator and may automatically return a tool to a known position on the operator or structure to which the tool is tethered.

In one embodiment, the hand tool built according to the invention comprises two lever arms, with the first and second lever arms each having a gripping jaw end, a handle end, and a first pivot point intermediate between the gripping jaw end and the handle end. The lever arms are pivotally coupled at the pivot points with a pivot member including a retraction assembly positioned within the pivot of the hand tool. In some embodiments, the pivot member may function as a pivot pin.

In another embodiment, the pivot member including the retractor assembly may be fixed to one of the lever arms, with only the other lever arm pivoting around the pivot member.

The retractor assembly generally includes a tether that has a free end that can be extended a desired length from the retractor. The free end generally will include a coupling device to couple to the user or to an anchor structure. Virtually any known coupling device may be used. The retractor assembly also includes a retraction mechanism for drawing the tether into the retractor assembly. Many kinds of retractor mechanisms are useable in the invention.

In some embodiments, the tethering apparatus may be modified to allow a locking mechanism for the tether. Such a mechanism allows for the operator to use the tool without exerting a counter force against the retracting mechanism during tool usage. When done, the operator disengages the locking mechanism. As an alternative to the locking mechanism, a ratchet mechanism may be substituted which would allow the tool to be extended away for the anchor point, but would not allow a potentially uncontrolled retraction back toward the user. One embodiment of a ratchet mechanism would require the operator to disengage the ratchet mechanism and hold the mechanism disengage while the tool retracted.

In another embodiment, the retraction mechanism may be configured so that the tension applied to the tether varies as the tether is unwound from the retraction mechanism. For example, the tension may be high when the tool are near the coupling device attached to the operator in order to prevent the pliers from bouncing on the tether when the operator is walking. The tension may fall as the tool is moved away from the coupling device in order to reduce resistance to the operators handling and use of the pliers.

LIST OF DRAWINGS

A better understanding of the present invention will be had upon reference to the accompanying drawings in which like numerals refer to like parts in the several views and in which.

DETAILED DESCRIPTION

Built in accord with the present invention is a tethering apparatus for use with hand tools in which the apparatus is adapted to be attached to, or incorporated into, the hand tool and having the opposite end of a tether adapted for attachment to an operator or to a selected anchoring structure. Like pre-existing tethers, the invention can prevent a hand tool from getting too far from the operator and may automatically return a tool to a known position on the operator or to a structure to which the tool is tethered. However, the embodiments of the invention disclosed herein represent an improvement over preexisting tethering mechanisms A common disadvantage of pre-existing tethering mechanisms is that they have the retracting mechanism for the tether located at the end attached to the operator. Whereas, the present invention instead provides the retraction mechanism at the hand tool end. This different configuration provides unexpected and surprising benefits including but not limited to the following. (1) The space required for coupling the tethered hand tool to the operator or to the selected support structure is smaller than that required in pre-existing designs. (2) Placing the retraction mechanism on the tools allows easy manipulation of the mechanism with the same hand holding the tool, without removing ones hand from the tool. Specifically, controls for locking means, and retraction brakes controls, can be placed in close proximity to the handle on the tool and can thus be engaged or activated while holding the tool. (3) The position of the retraction mechanism can be selected on the tool so that the hand tool always retracts to a same orientation when moved from a functional position to the storage position. (4) As no retraction mechanism is required on the end opposite the tool. Thus, a larger selection of coupling devices can be used, including coupling devices that might otherwise interfere with the operation of a retraction mechanism, is such retraction mechanism was positioned on the end of the tether opposite the tool.

Figure 6:
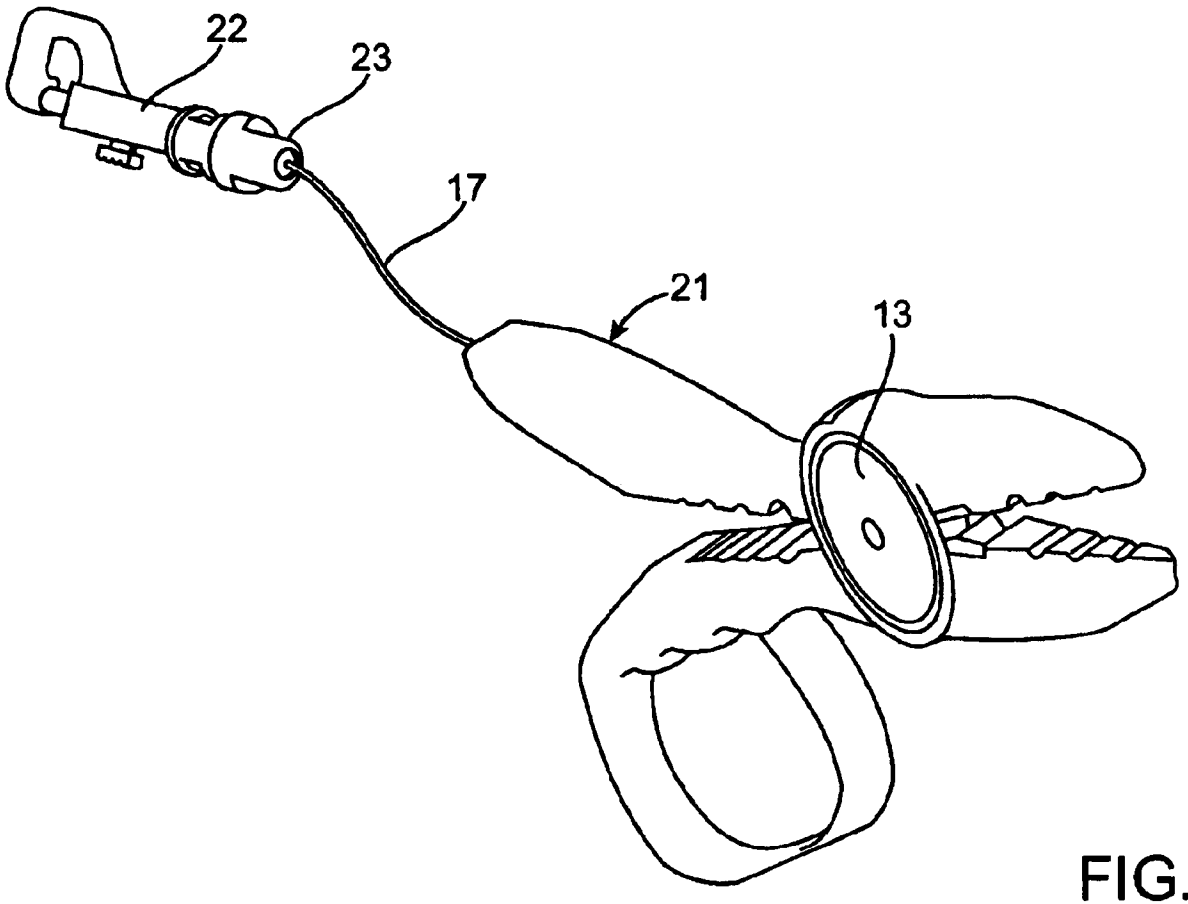
FIG. 6 shows an alternate embodiment of a pliers type tool built according to the present invention.
Figure 7:
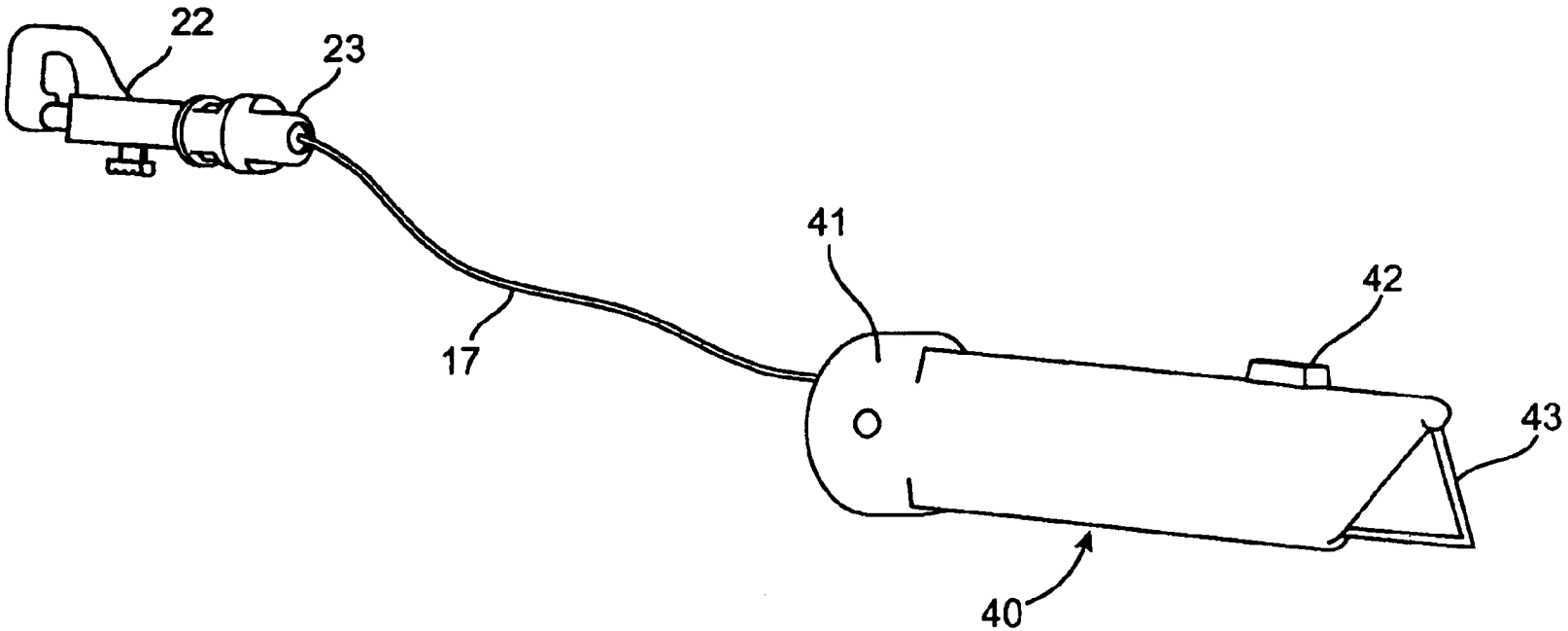
FIG. 7 shows another alternate embodiment of the invention.

Referring to the figures, a preferred embodiment will be described as an example of the design and operation of the invention. FIGS. 1 through 5 disclose a pair of pliers, designed for removing fish hooks, incorporating a tether and retraction mechanism of the invention. FIG. 6 is an alternate embodiment of a pliers type tool built according to the present invention, and FIG. 7 is another alternate embodiment of the invention. However, operators of hand tools, and those skilled in the art, will find the usefulness of this invention as it is applied to many different hand tools and any and all such hand tools should be considered within the scope of this invention. In addition to hand tools, in alternate embodiments virtually any hand held object including but not limited to cameras, garden tools, tape measures, wallets, and key rings may include a retraction mechanism according to the invention. The selection of the item to include the retractor, the coupling means, the retraction mechanism, and the configuration of the tether used can be easily made by those skilled in the art.

Figure 1:
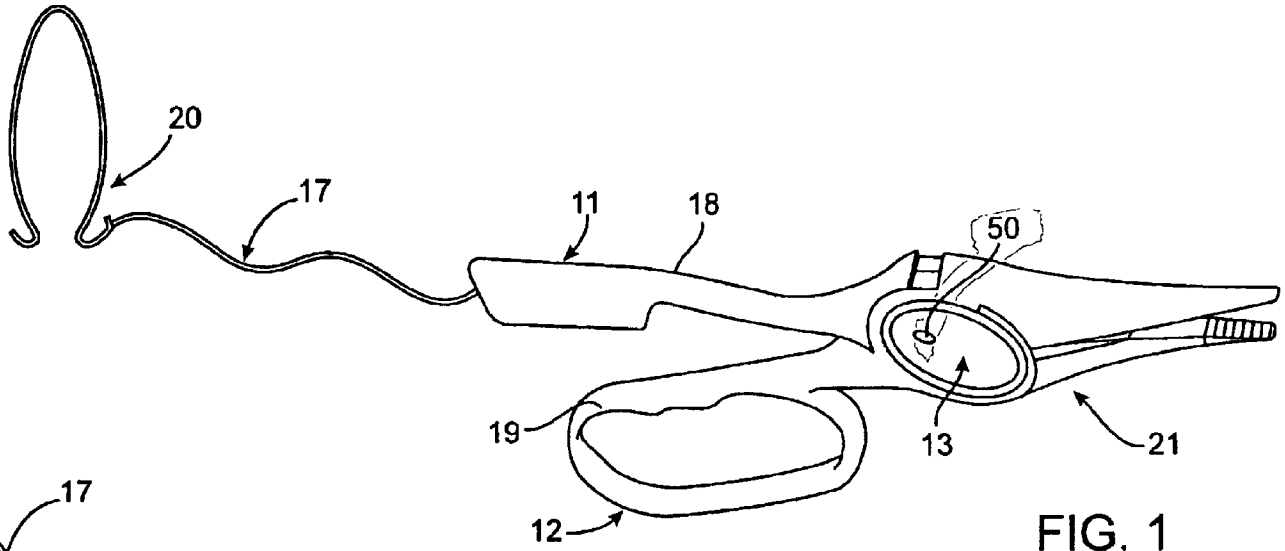
FIG. 1 shows a perspective view of an embodiment of the tethered tool according to the present invention.

Turning to FIG. 1, one embodiment of a pliers type tool 21 is shown including a retractor assembly 13 adapted to be included in the pivot of the pliers type hand tool 21, a tether 17 attached to the retractor 13, and coupling device 20 at the opposite end of the tether 17 allowing for attachment to the operator of the tool 21, or to a selected support structure. The retractor assembly 13, the tether 17, and the coupling device 20 may be collectively referred to as the tether apparatus. A large variety of materials may be used in the manufacture of the tool 21, and one skilled in the art can easily select appropriate materials.

In many conventional preexisting tethered tools, the retractor assembly resides at the end of the tether associated with the operator. Even if the retractor configuration is reversed and attached to the tool, the bulk of the retractor assembly may hinder operation of the tool. However, in the novel embodiment shown in FIG. 1, this disadvantage is avoided as the retractor assembly 13 is incorporated into the larger, outer circumference of the pivot, which is present and otherwise required for the operation of the pliers tool 21. Thus, it is apparent that the bulk associated with the tether apparatus of the invention is less burdensome than the bulk of some preexisting tethering systems.

Figure 2:
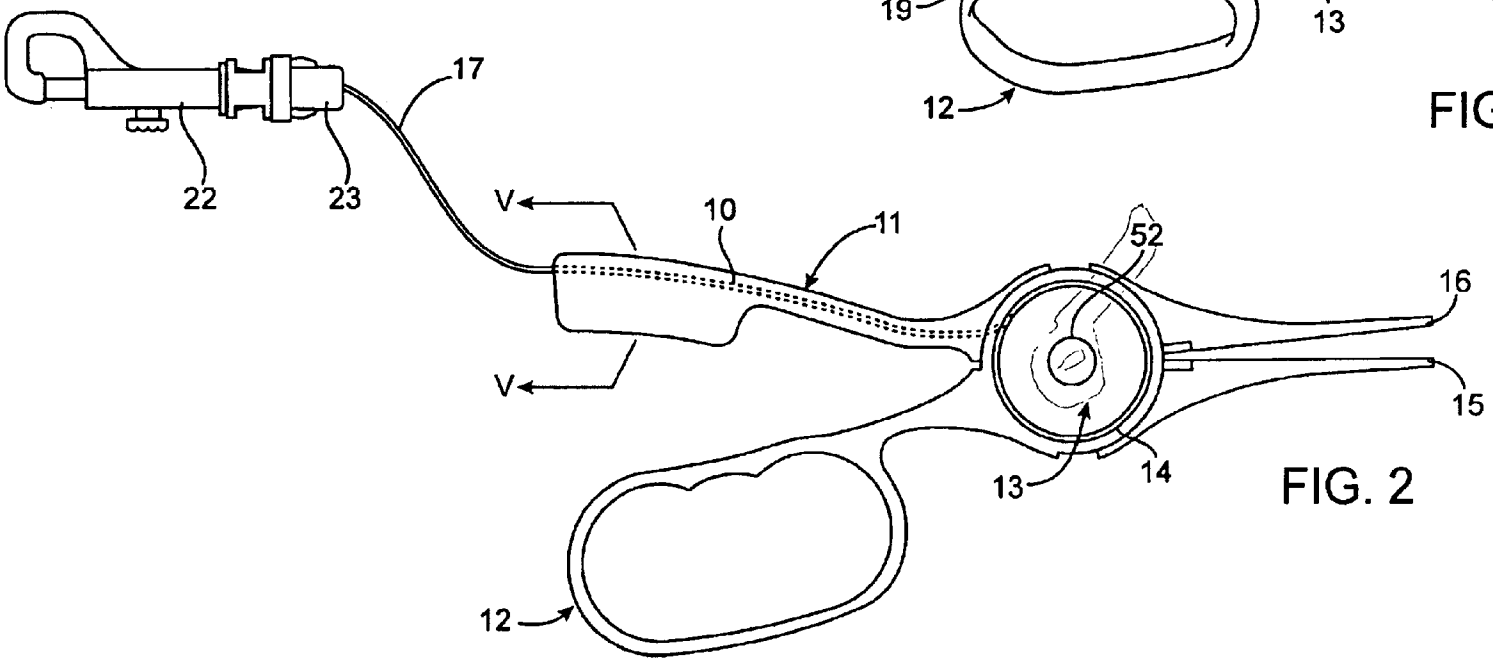
FIG. 2 shows a side view of an embodiment of the tool according to the present invention.
Figure 3:
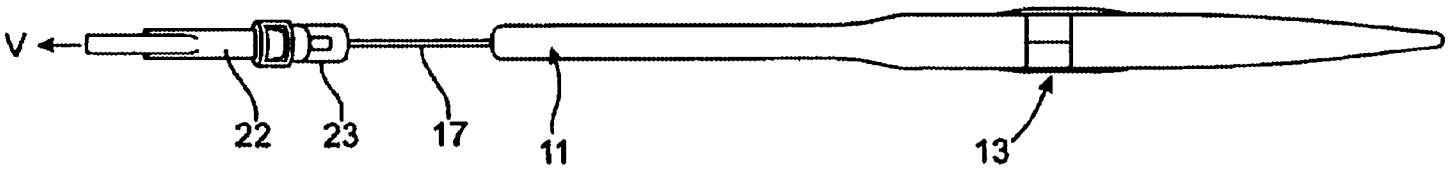
FIG. 3 shows a top view of an embodiment of the tool.

Referring to FIG. 2, a side view of the pliers 21 is shown. The pliers tool 21 includes first and second lever arms 11 and 12 pivotally coupled around a pivot comprising the retractor assembly 13. The lever arms 11 and 12 include first and second gripping jaws 15 and 16 respectively at one end, and first and second handle portions 18 and 19, and intermediate pivot rings 36 and 37 (best seen in FIG. 4). In the embodiment shown in the figures, lever arm 11 includes a channel 10 formed in the handle portion 18 of lever arm 11, used to guide the tether 17 through he handle portion 18 in order to keep the tether 17 from interfering with the handling of the tool 21. In alternate embodiments, the channel may be in the form of a lumen or bore, rather than a slot as shown in the FIGS. In still other alternate embodiments, the channel 10 may be removed. FIG. 3 is a top view of the pliers 21.

Figure 4:
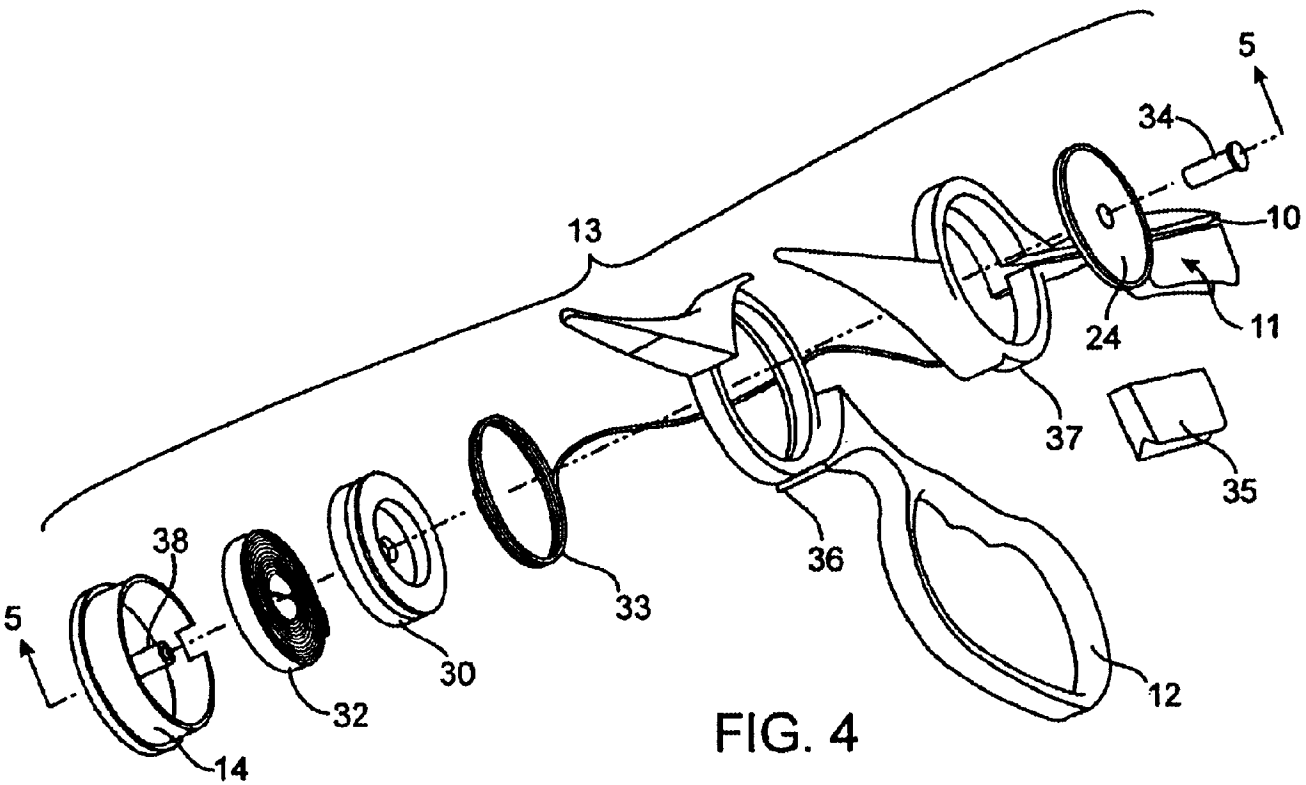
FIG. 4 shows an exploded, perspective view showing the major functional components of an embodiment of the tool.

FIG. 4 provides an exploded view of the pliers tool 21. The pivot rings 36 and 37 of the lever arms are configured to accept the housing 14 of the retractor assembly 13. The tether 33 is wound around a spool 30 with one end extending from the housing 14 through the channel space 10 in lever arm 11, and is attached to a coupling device 20, best seen in FIGS. 1–3. The retractor spring 32, provides the spring force required to automatically rewind tether 33 back onto spool 30 when the operator has completed using the pliers type tool 21. FIG. 4 also shows an optional sharpening stone 35 that fits in a portion of the arm 11 configured to received the sharpening stone 35. The sharpening stone 35 maybe used to sharpen items such as fishhooks or knives.

Retainer cover 24 provides containment for the retraction mechanism and protection from foreign particles from entering said mechanism. Fastener 34, secures the housing 14 and the retainer cover 24 together allowing the other discussed parts of the retractor assembly 13 to remain in their proper position. Fastener 34 may be a screw, rivet, or other selected fastener.

Figure 5:
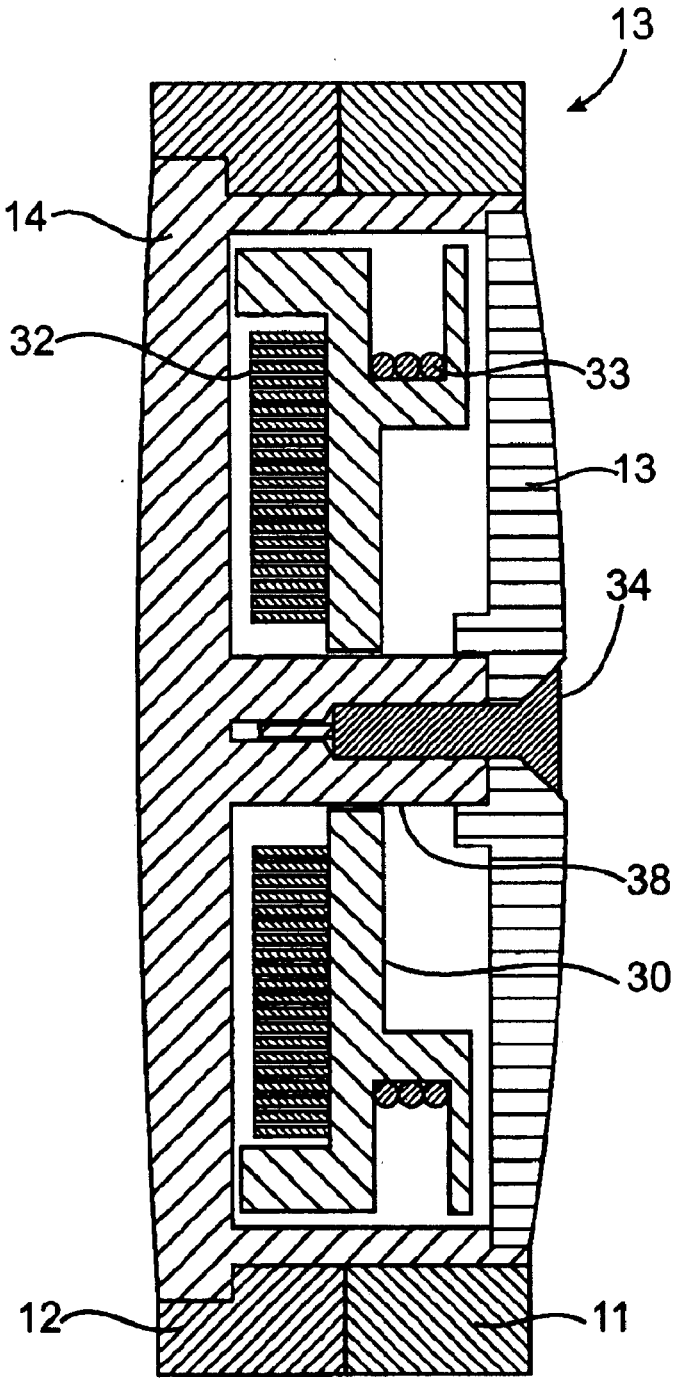
FIG. 5 shows a cross-section view taken on a plane formed by lines 5—5 of FIG. 4.

FIG. 5. Is a cross sectional view of the retractor assembly 13 of FIG. 2 taken along lines 5—5. As seen, there is a channel in spool 30 allowing for the winding of tether 33 along its outer circumference. In this preferred embodiment, the retraction spring 32 is located on the opposite side of the tether on spool 30. The spool is allowed to rotate on the shaft 38 of housing 14.

One embodiment of a retractor assembly 13 has been described. In some other embodiments the housing of the retractor assembly 13 may be non-pivotally fixed to one lever arm, with only the other lever arm rotating around the housing 14. Also, many other configurations of the described retractor assembly 13, and many other known retractor mechanisms may be useable by one skilled in the art, and those skilled in the art can readily select other known retractor mechanism that fit within the pivot of the hand tool 21.

A coupling apparatus is attached to the free end of the tether 17. The coupling apparatus allows for the flexible attachment of the pliers tool 21 to, for example, a boat, a tackle box, or to the user. FIG. 1 shows a simple hook, and FIGS. 2–6 show a piston hook. However, many kinds of coupling apparatus may be easily selected and used by one skilled in the art.

An enhancement to this embodiment includes connector 23, which allows the end of the tether to be removed form the piston hook 22 and attached to some other selected coupling device. This allows for the operator to employ a different attachment means that may be dependent on the type of surface to which the pliers 21 are to be attacked. For example, the piston hook could remain attached to a boat when connector 23 is detached, then the connector 23 could be attached to a hook on the operator's belt. This feature allows the pliers 21 to be easily and quickly moved between attachment locations as the operator may desire.

In still another alternate embodiment, the tethering apparatus 13 may be modified to allow a tether retraction control mechanism such as a locking mechanism, brake mechanism, or ratchet mechanism, which allows for the operator to use the tool 21 without exerting a counter force on the, refractor the retractor assembly while using the tool 21. These mechanisms allow the tool 21 to be extended away for the anchor point, but would not allow a potentially uncontrolled refraction back toward the user. Such mechanisms are known in the art and may be easily adapted by one skilled in the art for use in the invention. In one embodiment, the tether retraction control mechanism may require the operator to disengage the mechanism and hold the mechanism disengage while the tool 21 is retracted. An example optional retraction control mechanism 50 is shown in FIG. 1. In alternate embodiments the retraction control mechanism 50 could be located elsewhere.

In another alternate embodiment, the retraction mechanism 13 may be configured so that the tension applied to the tether 17 varies as the tether 17 is unwound from the retraction mechanism 13. For example, the tension may be high when the pliers 21 are near the coupling device 20 attached to the operator in order to prevent the pliers 21 from bouncing on the tether 17 when the operator is walking. The tension may fall as the pliers 21 are moved away form the coupling device 20 in order to reduce resistance to the operators handling and use of the pliers 21. An example optional tension control mechanism 52 is identified in FIG. 1. In alternate embodiments the tension control mechanism 52 could be located elsewhere.

Virtually any kind of hand tool can be configured and used in an alternate embodiment of this invention without departing materially from the teachings of this invention. Those skilled in the art can readily provide the adaptations required for inserting the tethering assembly 13 within such tools. An example of the retractor of the invention used on another kind of tool is seen in FIG. 7, which shows a carpet knife 40 incorporating a retractor 41. The button 42 is used to extend the knife blade 43 for use, but preferably also simultaneously activates a brake to prevent the tether 17 from retracting while the knife blade 43 is extended.

In use, the operator grabs tool 21 and extends the tool to its proper position. The unwinding tether 17 moves through channel 10 located in handle portion 18. The operator extends the tool 21 to the position for it to be useful and upon finishing the task, allows the tool 21 to be retracted to its storage location.

Although exemplary embodiments of the invention have been described in detail above, those skilled in the art will readily appreciate that many additional modifications are possible without departing materially from the novel teachings and advantages of the invention. For example, a different body attachment mechanism might support the tool directly without the need for the retracting force to support the tool in the retracted position.

What is claimed is:

1. A hand tool comprising:

a first lever arm, said first lever arm having a gripping jaw end, a handle end, and a first pivot point intermediate between said gripping jaw end and said handle end, a second lever arm, said second lever arm having a gripping jaw end, a handle end, and a second pivot point intermediate between said gripping jaw end and said handle end, and a pivot member, located at said pivot points of said first and second lever arms, comprising a retractor assembly, said retractor assembly including a tether.

2. The hand tool of claim 1 wherein said pivot point of said first and second pivot arms are defined by a pivot ring.

3. The hand tool of claim 1 wherein said first lever arm includes a tether channel.

4. The hand tool of claim 1 further comprising a coupling apparatus coupled to a first end of a tether, said tether being connected to said retractor assembly at a second end of said tether.

5. The hand tool of claim 1 further comprising a sharpening stone.

6. The hand tool of claim 1 further comprising a tether retraction control mechanism.

7. The hand tool of claim 1 wherein first lever arm is coupled at said first pivot point to said pivot member, and wherein said second lever arms is pivotally coupled at said second pivot point to said pivot member.

8. The hand tool of claim 1 wherein said first and second lever arms are coupled around said pivot member.

9. The hand tool of claim 1 wherein said second lever arm is pivotally coupled at said second pivot point to said first lever arm at said first pivot point.

10. A hand tool comprising:

a pivot member comprising a retractor assembly, a tether coupled to said retractor assembly at a first end, a first lever arm said first lever arm having a gripping jaw end, a handle end, and a first pivot point intermediate between said gripping jaw end and said handle end, said first lever arm being pivotally coupled around said pivot member at said first pivot point, a second lever arm said second lever arm having a gripping jaw end, a handle end, and a pivot point intermediate between said gripping jaw end and said handle end, second lever arm being pivotally coupled around said pivot member at said second pivot point, whereby said first and second pivot arms pivot around said pivot member at said pivot points.

11. The hand tool of claim 10 wherein said pivot point of said first and second pivot arms are defined by a pivot ring.

12. The hand tool of claim 10 wherein said first lever arm includes a tether channel.

13. The hand tool of claim 10 further comprising a coupling apparatus coupled to a second end of said tether.

14. A hand tool comprising:

a first lever arm, said first lever arm having a gripping jaw end, a handle end, and a first pivot point intermediate between said gripping jaw end and said handle end, a retractor housing fixed to said first lever arm proximate said pivot point, a retractor assembly positioned within said retractor housing, a tether having a first and a second end, said tether being connected at said first end to said retractor assembly, a second lever arm, said second lever arm having a gripping jaw end, a handle end, and a pivot point intermediate between said gripping jaw end and said handle end, second lever arm being pivotally coupled to said retractor housing at said pivot point of said second lever arm.

15. The hand tool of claim 14 wherein said pivot point of said second pivot arm is defined by a pivot ring configured to accept said retractor housing.

16. The hand tool of claim 14 wherein said first lever arm includes a tether channel.

17. The hand tool of claim 14 wherein said second lever arm includes a tether channel.

18. The hand tool of claim 14 further comprising a coupling apparatus coupled to a free end of said tether.

* * * * *